US006666522B2

(12) United States Patent
Bloom

(10) Patent No.: US 6,666,522 B2
(45) Date of Patent: Dec. 23, 2003

(54) FLOOR-STRIPPING TOOL

(76) Inventor: Bernard N. Bloom, 8221 SW. 187$^{th}$ St., Miami, FL (US) 33157

( * ) Notice: Subject to any disclaimer, the term of this patent is extended or adjusted under 35 U.S.C. 154(b) by 0 days.

(21) Appl. No.: 10/123,935

(22) Filed: Apr. 17, 2002

(65) Prior Publication Data

US 2003/0197419 A1 Oct. 23, 2003

(51) Int. Cl.$^{7}$ ..... A47L 13/02

(52) U.S. Cl. ..... 299/36.1; 15/93.1; 30/170; 37/266

(58) Field of Search ..... 299/36.1, 37.1, 299/39.1, 41.1; 15/93.1; 30/169–170; 81/45; 29/401.1; 241/101.1, 101.01; 37/266, 285; 414/607

(56) References Cited

U.S. PATENT DOCUMENTS 2,686,324 A * 8/1954 Costarella ..... 15/93.1
2,741,041 A * 4/1956 Wilson ..... 299/36.1 X
5,013,092 A * 5/1991 Kulhawy ..... 299/41.1 X
5,497,569 A * 3/1996 Byman ..... 37/410
5,533,790 A 7/1996 Weiland
5,560,129 A * 10/1996 Rothbart ..... 37/266 X
5,641,206 A 6/1997 Craft
6,299,257 B1 10/2001 Constantino
6,428,108 B1 * 8/2002 Chase ..... 299/36.1

OTHER PUBLICATIONS

"Bobcat.com", pallet forks, p. 1, undated.*
"Bobcat.com", super scraper, p. 1, undated.*

* cited by examiner

*Primary Examiner*—Heather Shackelford
*Assistant Examiner*—Sunil Singh
(74) *Attorney, Agent, or Firm*—Ruben Alcoba; Laurence Edson

(57) ABSTRACT

A floor-stripping tool for attachment to a standard pallet truck, thereby converting the pallet truck into a self-propelled floor stripper. The chassis structure of the tool includes fork holders, and stabilizing brackets. A blade attaches to a blade holder on the front stabilizing bracket. To remove a floor surface with the tool, a user first attaches the fork holders of the floor-stripping tool to the forks of a pallet truck; anchor bolts ensure a tight fit. The brackets are adjusted as needed. The forks of the pallet truck are lowered to insert the blades of the tool under the surface to be removed. Moving the forks forward removes the floor surface.

9 Claims, 4 Drawing Sheets

FLOOR-STRIPPING TOOL

BACKGROUND

1. Field of the Invention

The present invention relates to a floor stripping tool for attachment to a pallet truck. Once attached, the tool transforms the pallet truck into a self-propelled floor stripper.

2. Description of the Related Art

Self-propelled floor strippers are generally known in the art for interior remodeling projects. These floor strippers are expensive machines dedicated to the sole task of removing existing floor surfaces.

Self-propelled floor strippers have been disclosed in U.S. Patents. U.S. Pat. No. 5,533,790, to Weiland teaches a Floor Milling Machine. The machine mills the floor surface and then vacuums the removed matter into a waste hopper. Weiland's machine seeks to eliminate or reduce the release of dust into the surrounding air; hence it is intended for indoor use. U.S. Pat. No. 5,641,206 to Craft discloses an Apparatus for Removing a Surface Layer From a Floor or the Like. As with Weiland, Craft discloses a large machine upon which the operator sits. Craft's apparatus rises off its front wheels as a hydraulic actuator generates the force to remove the floor surface. U.S. Pat. No. 6,299,257 B1 to Constantino, discloses a Machine for Removing Tile with Articulated Frame. Constantino's machine provides an articulated structure, which allows the adjustment of the angle of its scrapper blade by pivot motion of its main body element.

Interior demolition presents a number of challenges. Floors are typically resurfaced in occupied commercial structures. The step of removing the previous surface is especially noisy and disruptive. Hence, it must be performed after normal working hours and on weekends. At these times workers must be paid higher wages. Additionally, removing the previous surface consumes much time, adding to the expense.

SUMMARY OF THE INVENTION

This invention relates generally to a floor-stripping tool. The tool has a chassis structure with forward and rear portions. A blade holder is mounted at the forward portion of the chassis structure. The blade holder secures a blade, and a material shield. The chassis structure is configured for attachment to the forks of a pallet truck. Pallet trucks are very common in industry and are relatively inexpensive compared to machines fully dedicated to floor surface removal. Attaching the floor-stripping tool to the pallet truck presents a self-propelled floor stripper. The chassis structure additionally has first and second fork holders, for receiving respectively the first and second forks of a pallet truck.

The fork holders have a generally "C" shape in cross-section, formed by upper and lower edges separated by fork holder sides. The fork holders abut the forks on three sides. The fork holders also have a plurality of anchor holes along the upper edges of the fork holders. Anchor bolts are received in these holes, thereby bolting the fork holders to the forks.

Forward, center, and rear brackets stabilize the fork holders. The brackets are adjustable to accommodate various pallet trucks. The forward bracket secures the blade holder. The forward bracket has a weight cradle for mounting weights.

To remove a floor surface, the fork holders are first attached to the forks of the pallet truck. Then the forward, rear, and center brackets are adjusted to accommodate the distance separating the forks of the pallet truck. When the forks of the pallet truck are lowered, the blades of the tool are inserted under the surface to be removed. Moving the pallet truck forward scrapes the surface from the floor.

Accordingly, it is a principle object of the invention to provide a tool for attachment to a conventional battery-powered pallet truck, thereby transforming the pallet truck into a floor stripper.

It is another object of the invention to provide an inexpensive battery-powered floor stripper.

It is a further object of the invention to provide a floor stripper with superior floor removal performance, in terms of increased speed, reduced noise, and superior preparation of the underlying substrate.

Yet another object of the invention is to provide a tool that is easily attachable to a variety of pallet trucks.

BRIEF DESCRIPTION OF THE DRAWINGS

These and other features, aspects, and advantages of the present invention will become better understood with regard to the following description, appended claims, and accompanying and drawings where:

DETAILED DESCRIPTION OF THE PREFERRED EMBODIMENTS

In order to be better understood, a description of the invention is herewith offered, based on a practical application of the above-mentioned drawings.

Figure 1:
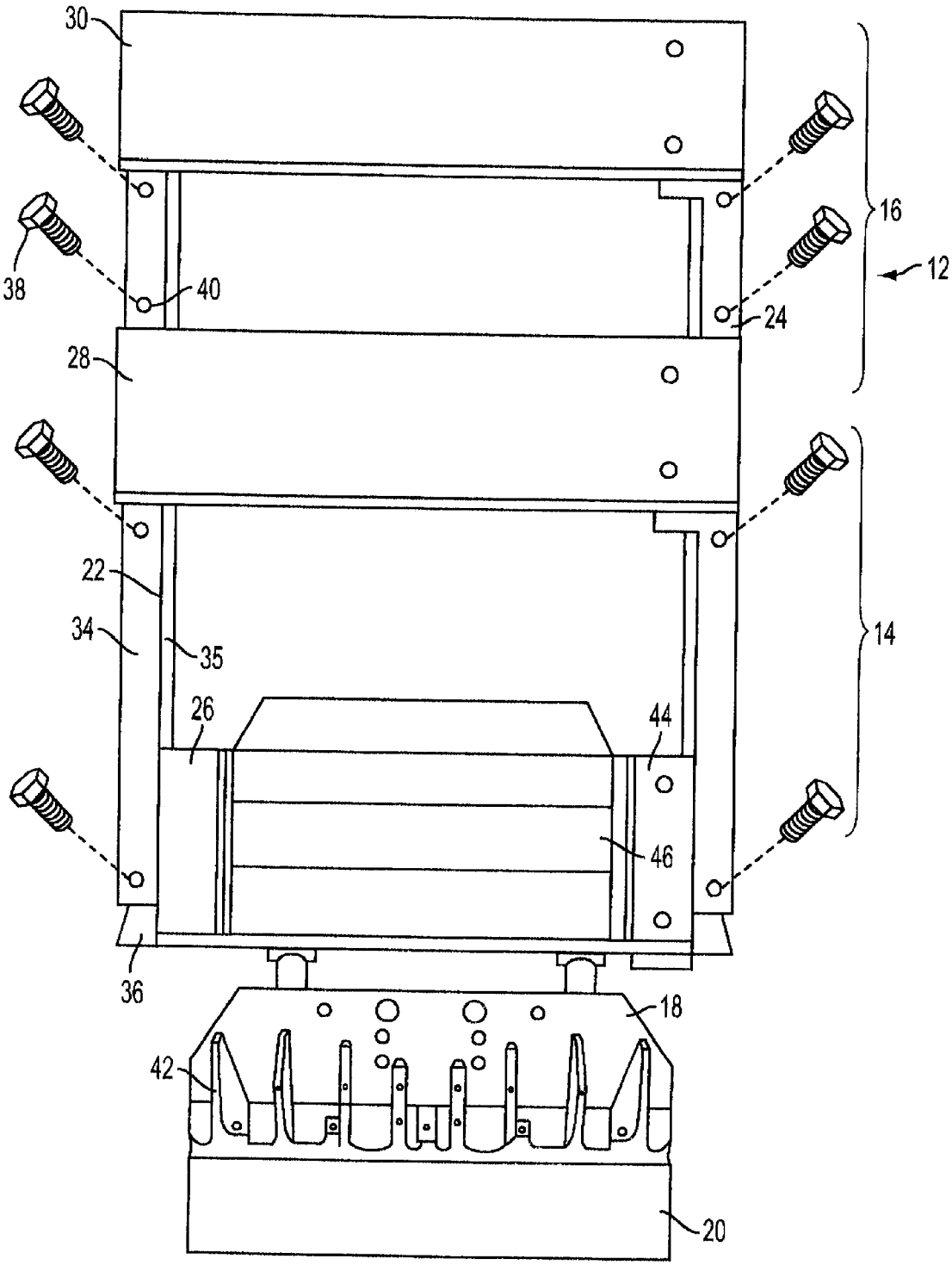
FIG. 1 illustrates a front, perspective view of the floor stripping tool according to the present invention.

The floor-stripping tool of the present invention is generally illustrated in FIG. 1. The chassis structure 12 provides the foundation of the present invention. The chassis 12 and its constituent parts are described in reference to forward and rear portions 14,16 of the chassis.

Figure 2:
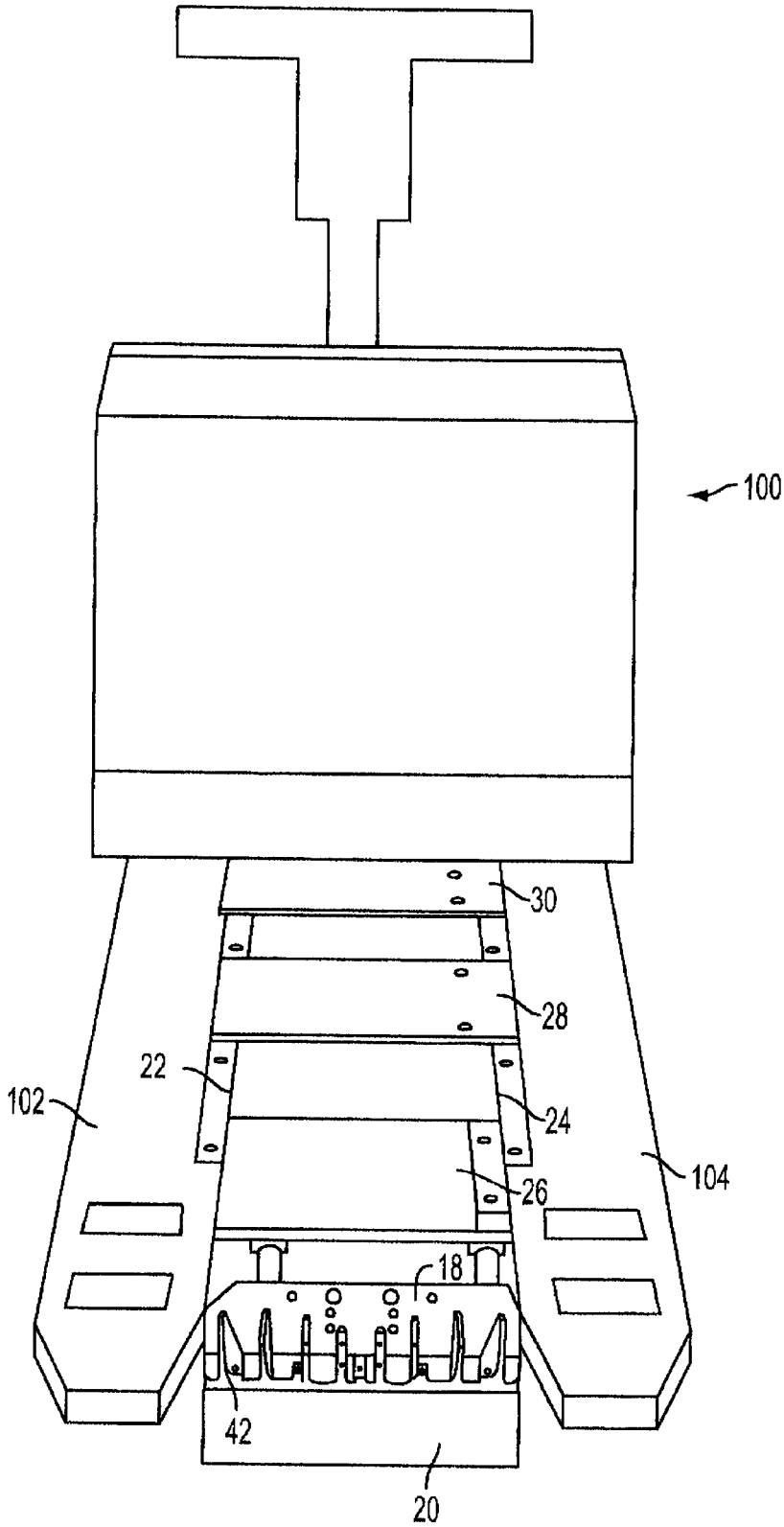
FIG. 2 illustrates a view of the floor-stripping tool according to the present invention attached to a conventional pallet truck.

The first and second fork holders 22,24 form the sides of the chassis 12. The first and second fork holders 22,24 are parallel to each other and their paired ends run from the rear portion 16 to the forward portion 14. In one embodiment, the fork holders 22,24 are forty-five inches long and separated by thirteen and one-quarter inches. The fork holders 22,24 each have upper and lower edges 34, 36 separated by a fork holder side 35. The fork holders 22,24 have a generally "C" shaped cross section. The fork holders 22,24 can be placed on the forks 102,104 of a pallet truck 100, and in this particular embodiment the fork holders 22,24 abut their respective forks 102,104 on three sides. This is illustrated in FIG. 2, a view of the floor-stripping tool in combination with a pallet truck.

The upper edges 34 of the fork holders 22,24 have a plurality of anchor holes 40 running their length. The anchor holes 40 receive anchor bolts 38, which secure the fork holders 22,24 to the forks 102,104 of the pallet truck 100.

The forward portion 14 of the chassis structure 12 has a forward stabilizing bracket 26 that connects the first and second fork holders 22,24. In the particular embodiment illustrated here, the forward stabilizing bracket 26 is attached to the lower edges 36 of the fork holders 22,24. The Forward stabilizing bracket additionally has a weight cradle 44 for mounting a weight 46. The weight 46 is attached to counter-balance the resistance encountered by the blade 20 as it removes the floor.

A blade holder 18 is attached to the forward bracket 26. The blade holder 18 holds the blade 20 and additionally a material shield 42. The blade 20 removes material from the floor surface, and the material shield 42 subsequently directs the material away from the tool.

At the rear portion 16 of the chassis 12, a rear-stabilizing bracket 30 connects the first and second fork holders 22,24; this bracket 30 is perpendicular to the fork holders 22,24 and keeps the holders 22,24 parallel in relation to each other. The embodiment of FIG. 1 shows a rear bracket attached to the upper edges 34, however the rear bracket might be attached to either the lower edge 36 or the fork holder side 35.

A center-stabilizing bracket 28 connects the first and second fork holders 22,24; as with the other stabilizing brackets, the center bracket 28 is perpendicular to the fork holders 22,24 and keeps the holders 22,24 parallel in relation to each other. The embodiment of FIG. 1 shows a center bracket 28 attached to the upper edges 34, however the center bracket 28 might be attached to either the lower edge 36 or the fork holder side 35. The center bracket 28 is between and parallel to the forward and rear brackets 26,30.

Figure 3A:
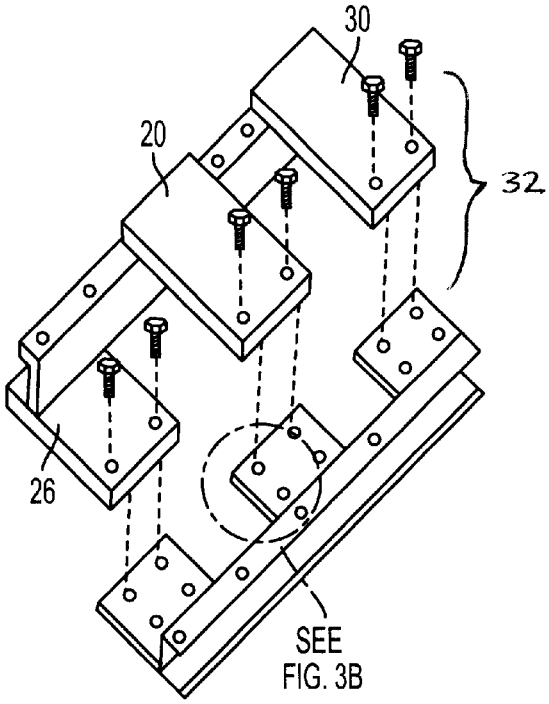
FIGS. 3A and 3B illustrate a close-up view of the adjusting means and fork holder of the present invention.
Figure 3B:
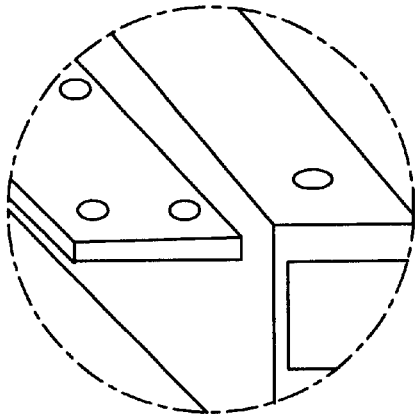

In one embodiment, all the brackets, forward, center, and rear 26,28,30 have an adjusting means 32. By adjusting the length of the brackets, the distance separating the first and second fork holders 22,24 can be changed to accommodate a variety of pallet trucks. FIG. 3 illustrates a close-up view of the adjusting means 32 and second fork holder 24 of the present invention. Here, the adjusting means 32 is shown on the forward-stabilizing bracket 26. However, the adjusting means is identical on all the brackets. The adjusting means is a division in the bracket, splitting the bracket into two pieces. The two pieces overlap and are bolted together. The pieces might overlap to varying degrees and be bolted together to achieve the desired distance of separation.

Figure 4A:
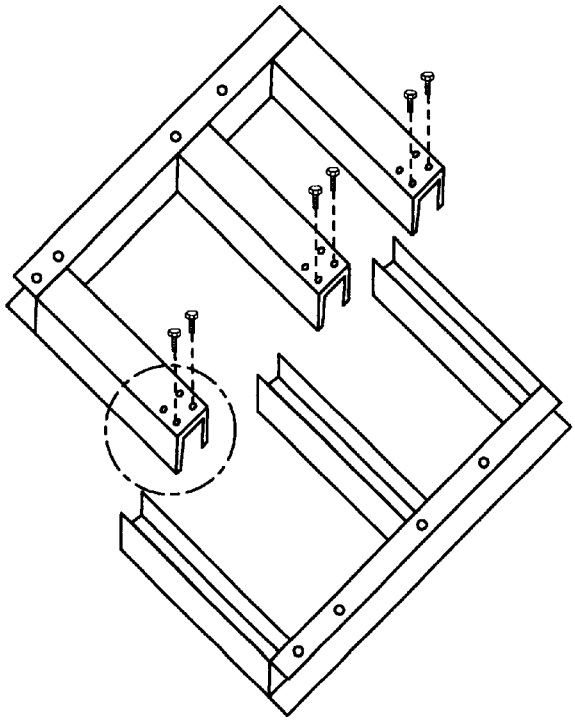
FIGS. 4A and 4B illustrate an alternative embodiment for the center bracket and its adjusting means.
Figure 4B:
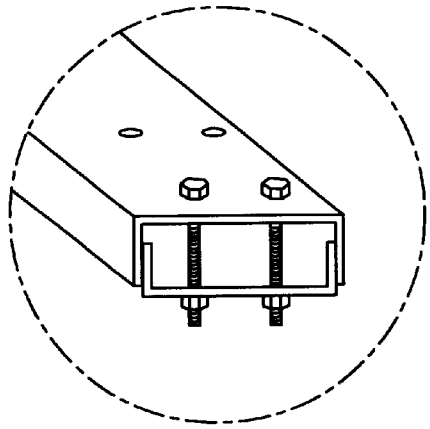

FIG. 4 illustrates an alternative configuration for the center bracket and its adjusting means. Here, the center bracket is attached to the fork holder side.

During operation of the floor-stripping tool the brackets undergo considerable stress. Hence, in one embodiment all the brackets are fabricated of one-inch thick steel plates.

Figure 5:
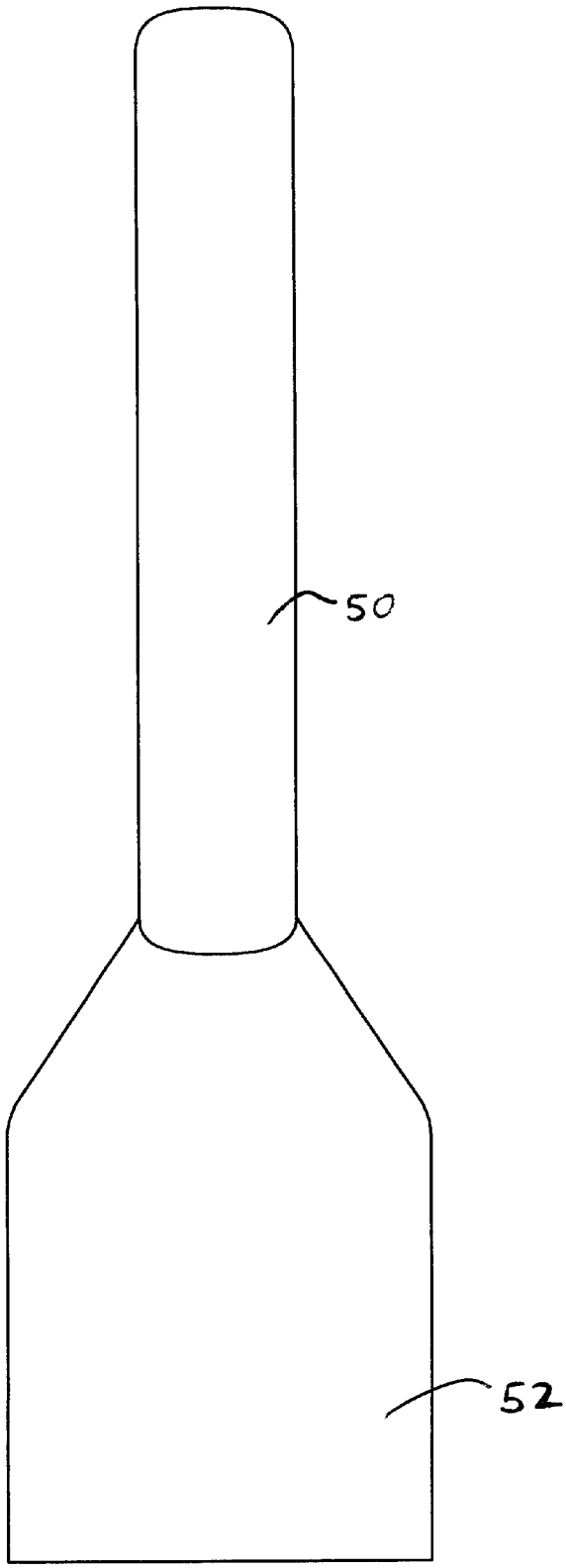
FIG. 5 illustrates an alternative, interchangeable blade for the present invention.

FIG. 5 illustrates an alternative, interchangeable blade apparatus for the present invention. The user selects a particular blade depending on its suitability for removing a particular floor surface. The alternative blade apparatus has an alternative holder 50, which is analogous to the blade holder 18. Further, the alternative holder 50 attaches to the forward bracket in the same manner as the blade holder 18. The alternative blade 52 of the alternative blade apparatus is analogous to the blade 20.

FIG. 2 illustrates the floor-stripping tool of the present invention in combination with a pallet truck 100. The tool is bolted onto the first and second forks 102,104 of the pallet truck 100. Pallet trucks are very common in industry and are relatively inexpensive compared to machines fully dedicated to floor surface removal. For example, YALE sells a low lift 4000 lb motorized hand pallet truck (Model: MPB 040AC) that might be combined with a floor-stripping tool.

To remove a floor surface, the fork holders are first attached to the forks of the pallet truck. Then the forward, rear, and center brackets are adjusted to accommodate the distance separating the forks of the pallet truck. When the forks of the pallet truck are lowered, the blades of the tool are inserted under the surface to be removed. Moving the pallet truck forward then removes the surface.

It is to be understood that the present invention is not limited to the embodiments described above, but encompasses any and all embodiments within the scope of the following claims.

I claim:

1. A floor-stripping tool, comprising:

a chassis structure having forward and rear portions, wherein the chassis structure defines a first and second fork holder for receiving the forks of a pallet truck and a forward stabilizing bracket at the forward portion for securing a blade holder, the forward bracket connects and is perpendicular to the first and second fork holders and has an adjusting means, for variably setting the distance between the first and second fork holders;

a center stabilizing bracket disposed between the forward and rear portions of the chassis structure, the center bracket connects and is perpendicular to the first and second fork holder and has an adjusting means, for variably setting the distance between the first and second fork holders;

a rear stabilizing bracket at the rear portion, the rear bracket connects and is perpendicular to the first and second fork holders and has an adjusting means, for variably setting the distance between the first and second fork holders;

a blade holder mounted on to the forward stabilizing bracket of the chassis structure; and a blade secured to the blade holder.

2. The tool of claim 1, wherein the adjusting means comprise the center, rear, and forward brackets divided thus providing two divided ends on the center, rear, and forward brackets, which are securable and variably overlap, thereby allowing the first and second fork holders to accommodate forks separated by various distances.

3. The tool of claim 1, wherein the first and second fork holders each have upper and lower edges spanning the length of the fork holders and fork holder sides separating the upper and lower edges, thereby providing a fork holder having a "C" cross-section for abutting the fork on three sides.

4. The tool of claim 3, further comprising: a plurality of anchor bolts; and a plurality of anchor holes along the upper edge of the first and second fork holders, the anchor holes for receiving the anchor bolts, and bolting the fork holders to the forks.

5. A floor-stripping tool, comprising:

a chassis sure having forward and rear portions, wherein the chassis structure defines a first and second fork holder for receiving the forks of a pallet truck and a forward stabilizing bracket at the forward portion for securing a blade holder, the forward bracket connects and is perpendicular to the first and second fork holders;

a center stabilizing bracket disposed between the forward and rear portions of the chassis structure, the center bracket connects and is perpendicular to the first and second fork holder;

a rear stabilizing bracket at the rear portion, the rear bracket connects and is perpendicular to the first and second fork holders;

a blade holder mounted on to the forward stabilizing bracket of the chassis structure;

a blade secured to the blade holder;

a weight cradle attached to the forward stabilizing bracket; and weights mounted to the weight cradle.

6. A floor-stripping tool in combination with a pallet truck, the combination comprising:

a pallet truck having forks;

a chassis structure having forward and rear portions, the chassis structure for attachment to the forks of the pallet truck, wherein the chassis structure further comprises of:

first and second fork holders for receiving the forks of the pallet truck;

a forward stabilizing bracket at the forward portion for securing the blade holder, the forward bracket connecting and perpendicular to the first and second fork holders;

a center stabilizing bracket disposed between the forward and rear portions of the chassis structure, the center bracket connecting and perpendicular to the first and second fork holders;

a rear stabilizing bracket at the rear portion, the rear bracket connecting and perpendicular to the first and second fork holders.

a blade holder mounted on the forward portion of the chassis structure; and a blade secured to the blade holder.

7. The combination of claim 6, wherein the first and second fork holders each have upper and lower edges spanning the length of the fork holders and fork holder sides separating the upper and lower edges, thereby providing a fork holder having a "C" cross-section for abutting the fork on three sides.

8. The combination of claim 7, further comprising:

a plurality of anchor bolts; and a plurality of anchor holes along the upper edge of the first and second fork holders, the anchor holes for receiving the anchor bolts, and bolting the fork holders to the forks.

9. The combination of claim 6, further comprising:

a material shield mounted on the blade holder, the material shield having a surface for receiving material removed by the blade, and directing the material away from the tool;

a weight cradle attached to the forward stabilizing bracket; and weights mounted to the weight cradle.

* * * * *